US006523439B1

(12) United States Patent
Huang

(10) Patent No.: US 6,523,439 B1
(45) Date of Patent: Feb. 25, 2003

(54) RATCHET STRUCTURE OF A SCREWDRIVER

(76) Inventor: Ping Wen Huang, 1F, No. 364, Sec.2, Chung Yang Road, Hsien-Hsi Tsun, Chang-Hua Hsien (TW)

( * ) Notice: Subject to any disclaimer, the term of this patent is extended or adjusted under 35 U.S.C. 154(b) by 0 days.

(21) Appl. No.: 10/136,371

(22) Filed: May 2, 2002

(51) Int. Cl.[7] ..... B25B 13/46
(52) U.S. Cl. ..... 81/63.1; 192/43.1; 81/62
(58) Field of Search ..... 81/60–63.2; 192/43.1

(56) References Cited

U.S. PATENT DOCUMENTS 6,206,160 B1 * 3/2001 Chen ..... 81/63.1
6,227,077 B1 * 5/2001 Chiang ..... 81/63

* cited by examiner

*Primary Examiner*—D. S. Meislin
(74) *Attorney, Agent, or Firm*—Rosenberg, Klein & Lee

(57) ABSTRACT

A ratchet structure of a screwdriver, including a seat body disposed on a handle of the screwdriver, a ratchet mechanism and a cap member. The seat body is formed with a central cavity through which a stem of the ratchet mechanism is fitted. Two sides of the cavity are formed with left and a right chambers which symmetrically extend for receiving therein a left and a right dogs of the ratchet mechanism. The seat body is formed with two projecting sections respectively corresponding to the left and right dogs for supporting the same. The cap member is formed with a projecting block corresponding to the left and right dogs. When turning the cap member, the projecting block pushes and deflects the left dog or the right dog to disengage from a toothed section of the stem so as to control the rotational direction of the stem driven by the seat body.

4 Claims, 4 Drawing Sheets

RATCHET STRUCTURE OF A SCREWDRIVER

BACKGROUND OF THE INVENTION

The present invention is related to an improved ratchet structure of a screwdriver, and more particularly to a ratchet structure in which the middle sections of the left and right dogs of the ratchet mechanism are respectively supported by projecting sections of a seat body. By means of turning the cap member, the swinging positions of the left and right dogs can be switched so as to more truly and conveniently operate the ratchet mechanism.

FIGS. 6 to 8 show a conventional ratchet screwdriver. The handle 8 is formed with a cavity 81 through which a stem 82 is fitted. A section of the stem 82 in the cavity 81 is a toothed section 821. The handle 8 is further formed with two pairs of radially opposite chambers 83 communicating with the cavity 81. A leaf spring 84 and a dog 85 are disposed in each chamber 83. The leaf spring 84 pushes the dog 85 to engage with the toothed section 821 of the stem 82. The center of inner face of the upper cap 86 is formed with a circular projecting block 87. The projecting block 87 has two radially oppositely extending projecting sections 871. When turning the upper cap 86, the two projecting sections 871 respectively push away the opposite dogs 85 to change the rotational direction of the stem 82 driven by the handle 8. In addition, the inner side of the upper cap 86 is formed with a projecting locating block 88. The handle 8 is formed with three locating sections 89 corresponding to the locating block 88. The locating sections 89 are respectively formed in three positions where different dogs 85 are respectively pushed away by the projecting sections 871 of the projecting block 87 and where no dogs 85 are pushed away by the projecting sections 871. Accordingly, the locating block 88 can locate the upper cap 86 in any of the three positions.

According to the above structure, the two projecting sections 871 of the circular projecting block 87 extend radially opposite to each other. The edges of the projecting sections 871 are formed with two guide faces 872 adjacent to the projecting block 87. A stop face 873 is formed between each two guide faces 872. The four chambers 83 also radially extend as the projecting sections 871. Therefore, the guide faces 872 are nearly parallel to the lateral sides of the dogs 85 disposed in the chambers 83. As a result, it is laborious to turn the upper cap 86 and make the guide faces 872 of the projecting sections 871 push away the dogs 85. Furthermore, under limitation of the dimension of the cavity 81, the size of the projecting sections 871 cannot be freely enlarged. Accordingly, when turning the upper cap 86 to make the stop faces 873 of the projecting sections 871 respectively push away the dogs 85, the dogs 85 are retracted into the chambers just in flush with the outer circumference of the cavity 81 as shown in FIG. 8. The toothed section 821 of the stem 82 can just pass over the dogs 85. However, after a period of use, the stop faces 873 will be inevitably worn and depressed, so that the stop faces 873 will be unable to fully push the dogs 85 away from the cavity 81. As a result, the toothed section 821 of the stem 82 will collide the dogs 85 and the ratchet mechanism can be hardly truly operated.

SUMMARY OF THE INVENTION

It is therefore a primary object of the present invention to provide improved ratchet structure of a screwdriver in which the middle sections of the left and right dogs of the ratchet mechanism are respectively supported by the projecting sections of the seat body. In addition, the left and right dogs are respectively pushed by two springs to engage with the toothed section of the stem. When turning the cap member, the projecting block in the cap member can easily push and deflect the left dog or right dog and truly disengage the left dog or right dog from the toothed section of the stem. Accordingly, the ratchet screwdriver can be more conveniently and truly operated.

It is a further object of the present invention to provide the above ratchet structure in which the steel ball disposed in the receptacle and the two ball bodies disposed in the left and right through holes together support the inner circumference of the cap member so as to reduce the frictional resistance against the cap member when turned. Therefore, the cap member can be more smoothly turned.

The present invention can be best understood through the following description and accompanying drawings wherein:

DETAILED DESCRIPTION OF THE PREFERRED EMBODIMENT

Figure 1:
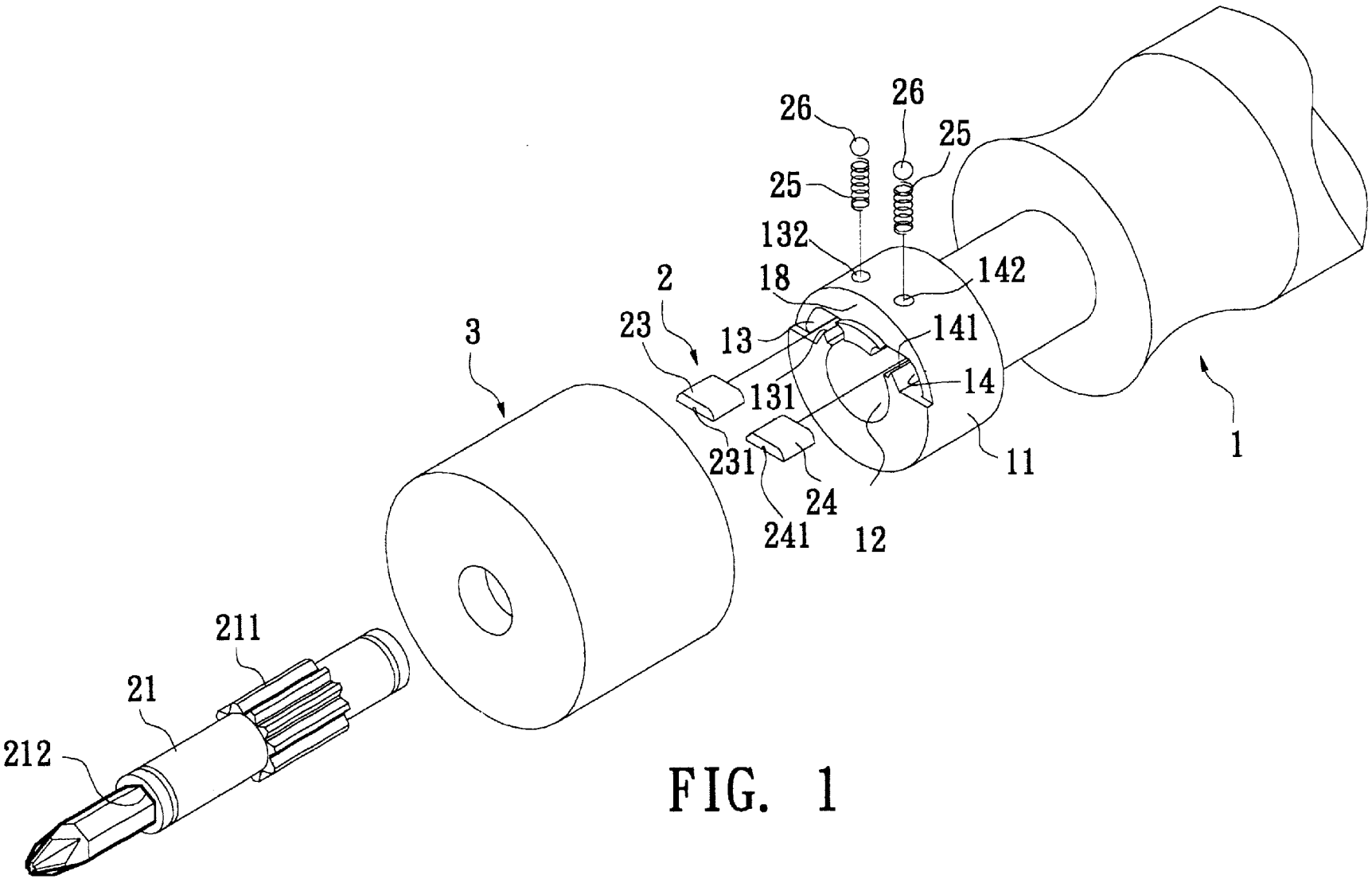
FIG. 1 is a perspective exploded view of the present invention.
Figure 2:
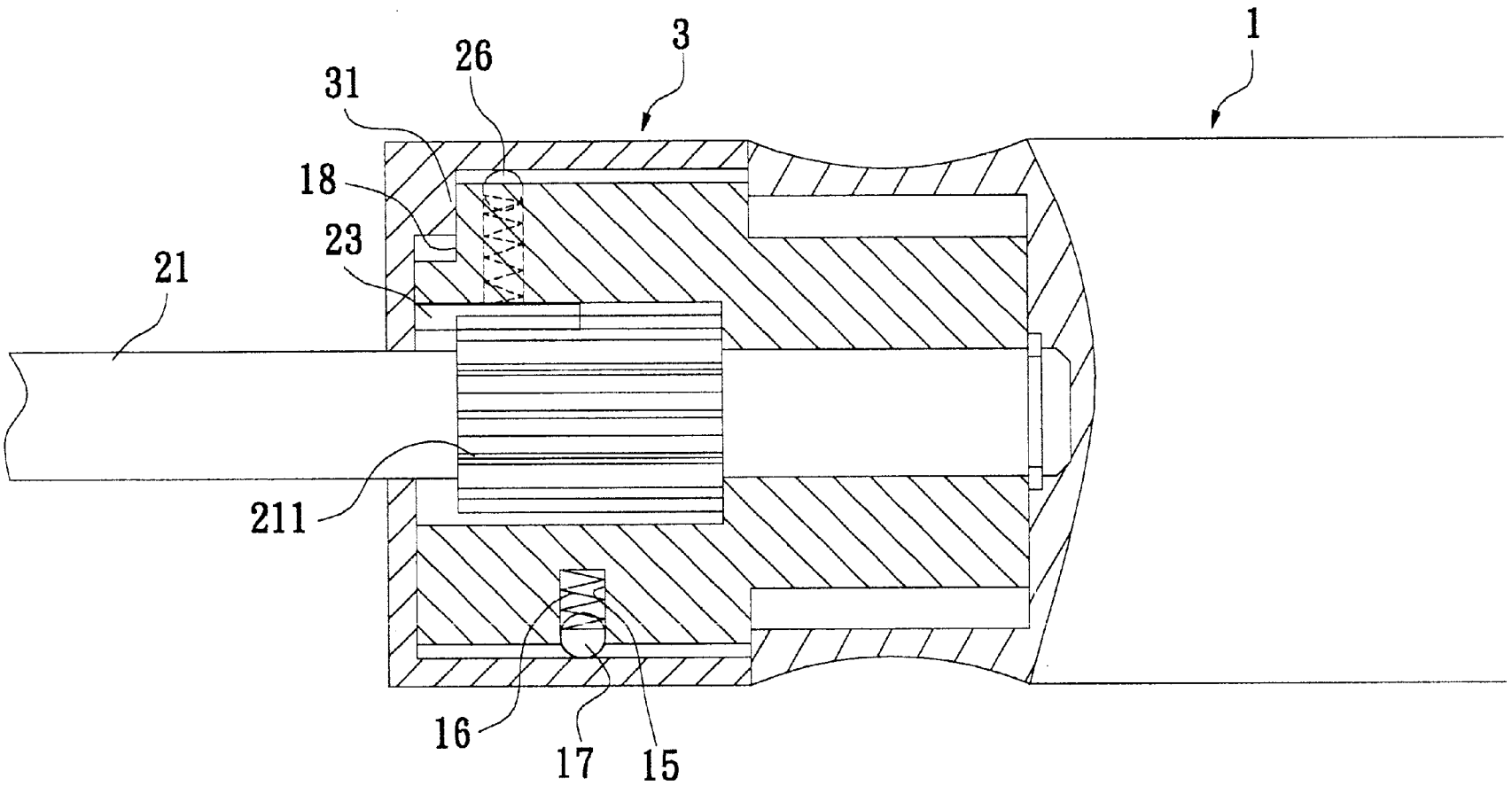
FIG. 2 is a sectional assembled view of the present invention.
Figure 3:
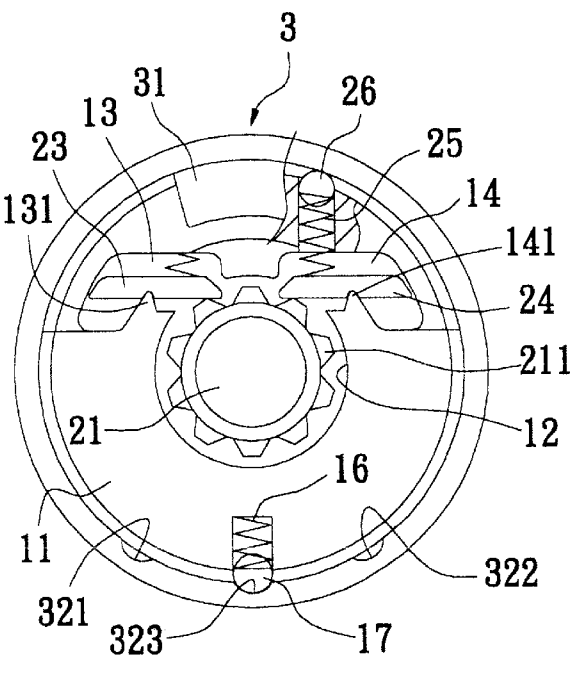
FIG. 3 shows a first using state of the present invention and the arrangement of the ratchet mechanism in the seat body and the cap member.
Figure 6:
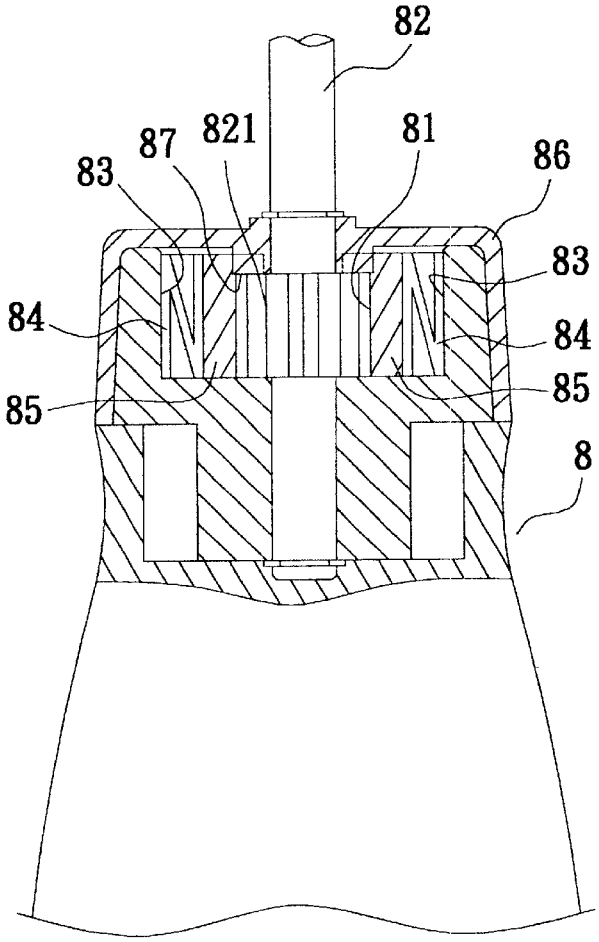
FIG. 6 PRIOR ART
FIG. 6 is a longitudinal sectional view of a conventional ratchet screwdriver.
Figure 7:
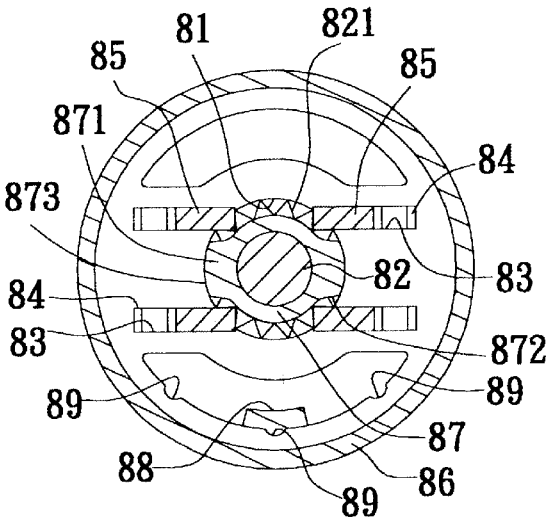
FIG. 7 PRIOR ART
FIG. 7 is a cross-sectional view of the conventional ratchet screwdriver.
Figure 8:
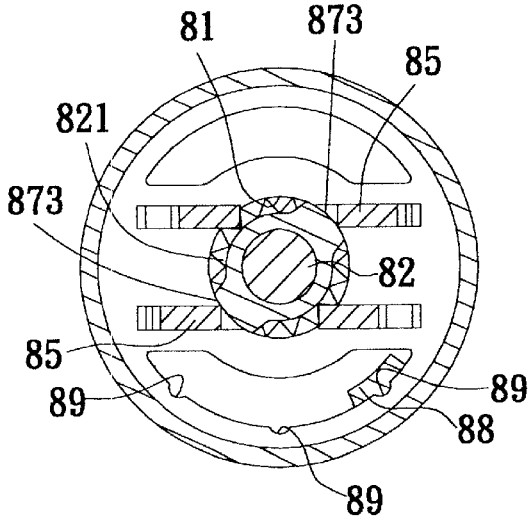
FIG. 8 PRIOR ART
FIG. 8 is a cross-sectional view according to FIG. 7, showing a using state of the conventional ratchet screwdriver.

Please refer to FIGS. 1 to 3. The ratchet structure of the screwdriver of the present invention includes a seat body 11 disposed on the handle 1 of the screwdriver, a ratchet mechanism 2 disposed in the seat body 11 and a cap member 3 fitted around the seat body 11.

The center of the seat body 11 is formed with a circular cavity 12. Two sides of the cavity 12 are respectively formed with a left and a right chambers 13, 14 symmetrically extending and communicating with the cavity 12. The seat body 11 is formed with a receptacle 15 inward extending from outer circumference of the seat body 11. A first spring 16 and a steel ball 17 are disposed in the receptacle 15. The first spring 16 outward pushes the steel ball 17.

The ratchet mechanism 2 has a stem 21 fitted through the cavity 12 of the seat body 11. A section of the stem 21 corresponding to the cavity 12 is a toothed section 211. One end of the stem 21 distal from the seat body 11 has a bit connecting section 212. The ratchet mechanism 2 includes a left and a right dogs 23, 24 respectively disposed in the left and right chambers 13, 14 of the seat body 11. In the left and right chambers 13, 14, the seat body 11 is formed with projecting sections 131, 141 respectively corresponding to the middle sections of the left and right dogs 23, 24 for supporting the same. The left and right dogs 23, 24 are respectively formed with notches 231, 241 corresponding to and in cooperation with the projecting sections 131, 141. The projecting sections 131, 141 are inlaid in the notches 231, 241. In addition, the left and right chambers 13, 14 are respectively formed with a left and a right through holes 132, 142 passing through the seat body 11. A second spring 25 is disposed in each of the left and right through hole 132, 142. Two ends of the second springs 25 respectively push the left and right dogs 23, 24 to engage with the toothed section 211 of the stem 21. The other two ends of the second springs 25 opposite to the ends pushing the left and right dogs 23, 24 are respectively provided with two ball bodies 26 which are pushed by the second springs 25 to abut against the inner circumference of the cap member 3.

The cap member 3 is formed with a projecting block 31 corresponding to the left and right dogs 23, 24. When turning the cap member 3, the projecting block 31 can push and deflect-the left dog 23 or the right dog 24 to disengage from the toothed section 211 of the stem 21 so as to control the rotational direction of the stem 21 driven by the seat body 11. The seat body 11 is formed with a depression 18 corresponding to the moving range of the projecting block 31 of the cap member 3 for accommodating the projecting block 31. The cap member 3 is formed with a left locating section 321, a right locating section 322 and a middle locating section 323 corresponding to the steel ball 17 of the seat body 11. The left locating section 321 is formed in a position where the projecting block 31 pushes the left dog 23. The right locating section 322 is formed in a position where the projecting block 31 pushes the right dog 24. The middle locating section 323 is formed in a position where the projecting block 31 pushes neither the left dog 23 nor the right dog 24. The steel ball 17 can be engaged in any of the locating sections to locate the cap member 3.

In use, the cap member 3 is turned to aim the middle locating section 323 at the steel ball 17, whereby the steel ball 17 is pushed by the spring 16 to engage in the middle locating section 323. At this time, the projecting block 31 of the cap member 3 pushes neither the left dog 23 nor the right dog 24, whereby the left and right dogs 23, 24 are respectively pushed by the second springs 25 to both engage with the toothed section 211 of the stem 21 as shown in FIG. 3. Under such circumstance, no matter whether a user clockwise or counterclockwise turns the handle 1, the stem 21 is driven and rotated.

Figure 4:
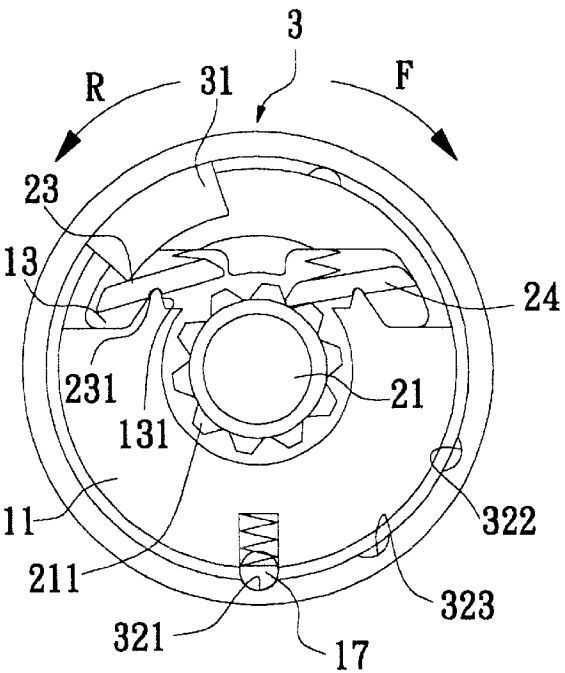
FIG. 4 is a view according to FIG. 3, showing a second using state of the present invention.

In the case that the cap member 3 is turned to engage the steel ball 17 in the left locating section 321, the projecting block 31 of the cap member 3 pushes the left dog 23, whereby the left dog 23 is swung about the projecting section 131 in the left chamber 13 inlaid in the notch 231 of the left dog 23 and thus the left dog 23 is disengaged from the toothed section 211. At this time, only the right dog 24 is engaged with the toothed section 211 as shown in FIG. 4. Under such circumstance, when the user turns the screwdriver and makes the seat body 11 rotate in a counterclockwise direction R in FIG. 4, the right dog 24 will drive the toothed section 211 of the stem 21 to make the stem 21 rotate. Reversely, when the user turns the screwdriver and makes the seat body 11 rotate in a clockwise direction F in FIG. 4, the right dog 24 is pushed away by the toothed section 211 of the stem 21 so that the stem 21 will not be driven.

Figure 5:
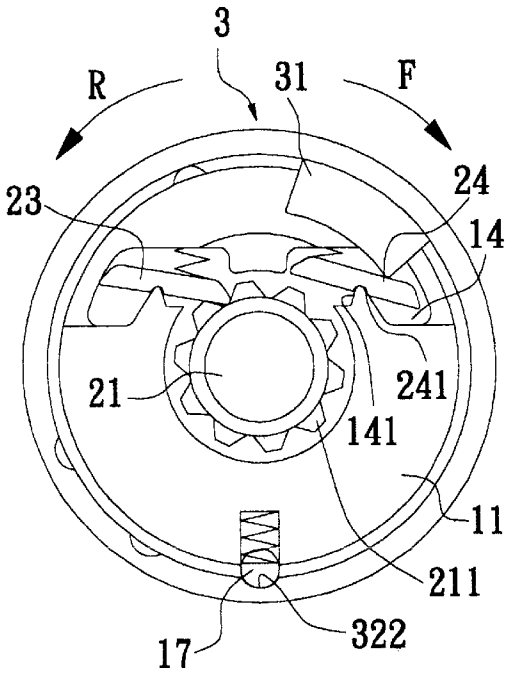
FIG. 5 is a view according to FIG. 3, showing a third using state of the present invention.

In the case that the cap member 3 is turned to engage the steel ball 17 in the right locating section 322, the projecting block 31 of the cap member 3 pushes the right dog 24, whereby the right dog 24 is swung about the projecting section 131 in the right chamber 14 inlaid in the notch 241 of the right dog 24 and thus the right dog 24 is disengaged from the toothed section 211. At this time, only the left dog 23 is engaged with the toothed section 211 as shown in FIG. 5. Under such circumstance, when the user turns the screwdriver and makes the seat body 11 rotate in a clockwise direction F in FIG. 5, the left dog 23 will be pushed away by the toothed section 211 of the stem 21 so that the stem 21 will not be driven. Reversely, when the user turns the screwdriver and makes the seat body 11 rotate in a counterclockwise direction R in FIG. 5, the left dog 23 will drive the toothed section 211 of the stem 21 to make the stem 21 rotate.

The projecting sections 131, 141 in the left and right chambers 13, 14 are respectively inlaid in the notches 231, 241 of the middle sections of the left and right dogs 23, 24, whereby the left and right dogs 23, 24 are like teeters. Accordingly, when turning the cap member 3, the projecting block 31 can easily push the left dog 23 or right dog 24 to swing. At this time, one end of the left dog 23 or right dog 24 adjacent to the toothed section 211 is lifted out of the cavity 12 to totally disengage from the toothed section 211. Accordingly, the ratchet mechanism 2 can be more truly operated without failure as in the conventional structure.

Furthermore, the inner circumference of the cap member 3 is not directly in contact with the seat body 11. Instead, the steel ball 17 disposed in the receptacle 15 and the ball bodies 26 disposed in the left and right through holes 132, 142 together support the cap member 3. Therefore, when turning the cap member 3, the steel ball 17 and the ball bodies 26 will roll to reduce the frictional resistance so that the cap member 3 can be more smoothly turned.

In conclusion, the middle sections of the left and right dogs 23, 24 are respectively supported by the projecting sections 131, 141. When turning the cap member 3, the projecting block 31 can easily push the left dog 23 or right dog 24 to swing. At this time, the left dog 23 or right dog 24 is pushed out of the cavity 12 and totally disengaged from the toothed section 211 of the stem 21. Accordingly, the ratchet screwdriver can be more conveniently and truly operated.

Furthermore, the steel ball 17 and the two ball bodies 26 together support the inner circumference of the cap member 3 so as to reduce the frictional resistance against the cap member 3 when turned. Therefore, the cap member 3 can be more smoothly turned.

The above embodiment is only used to illustrate the present invention, not intended to limit the scope thereof. Many modifications of the above embodiment can be made without departing from the spirit of the present invention.

What is claimed is:

1. A ratchet structure of a screwdriver, comprising a seat body disposed on a handle of the screwdriver, a ratchet mechanism disposed in the seat body and a cap member fitted around the seat body, wherein:

a center of the seat body is formed with a circular cavity, two sides of the cavity being respectively formed with a left and a right chambers symmetrically extending and communicating with the cavity, the seat body being formed with a receptacle inward extending from outer circumference of the seat body, a spring and a steel ball being disposed in the receptacle, the spring outward pushing the steel ball;

the ratchet mechanism has a stem fitted through the cavity of the seat body, a section of the stem corresponding to the cavity being a toothed section, one end of the stem distal from the seat body having a bit connecting section, the ratchet mechanism further including a left and a right dogs respectively disposed in the left and right chambers of the seat body, the seat body being formed with projecting sections respectively corresponding to middle sections of the left and right dogs for supporting the same, the left and right chambers being respectively formed with a left and a right through holes passing through the seat body, a spring being disposed in each of the left and right through hole, two ends of the springs respectively pushing the left and right dogs to engage with the toothed section of the stem; and the cap member is formed with a projecting block corresponding to the left and right dogs, whereby when turning the cap member, the projecting block can push and deflect the left dog or the right dog to disengage from the toothed section of the stem so as to control the rotational direction of the stem driven by the seat body, the cap member being formed with a left locating section, a right locating section and a middle locating section corresponding to the steel ball of the seat body, the left locating section being formed in a position where the projecting block pushes the left dog, the right locating section being formed in a position where the projecting block (31) pushes the right dog, the middle locating section being formed in a position where the projecting block pushes neither the left dog nor the right dog, whereby the steel ball can be engaged in any of the locating sections to locate the cap member.

2. The ratchet structure of a screwdriver as claimed in claim 1, wherein the left and right dogs are respectively formed with notches corresponding to and in cooperation with the projecting sections.

3. The ratchet structure of a screwdriver as claimed in claim 1, wherein the seat body is formed with a depression corresponding to a moving range of the projecting block of the cap member for accommodating the projecting block.

4. The ratchet structure of a screwdriver as claimed in claim 1, wherein the other two ends of the springs opposite to the ends pushing the left and right dogs are respectively provided with two ball bodies which are pushed by the springs to abut against inner circumference of the cap member.

* * * * *